US009183737B1

(12) United States Patent
Billman

(10) Patent No.: US 9,183,737 B1
(45) **Date of Patent: *Nov. 10, 2015**

(54) SMOKE DETECTOR TESTING

(71) Applicant: United Services Automobile Association (USAA), San Antonio, TX (US)

(72) Inventor: Bradly J. Billman, San Antonio, TX (US)

(73) Assignee: United Services Automobile Association (USAA), San Antonio, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/920,787

(22) Filed: Jun. 18, 2013

Related U.S. Application Data

(60) Continuation of application No. 12/247,417, filed on Oct. 8, 2008, now Pat. No. 8,466,800, which is a division of application No. 12/139,901, filed on Jun. 16, 2008, now abandoned.

(51) Int. Cl.
*G08B 21/00* (2006.01)
*G08B 29/14* (2006.01)

(52) U.S. Cl.
CPC ..... *G08B 29/145* (2013.01)

(58) Field of Classification Search
CPC ..... G08B 17/10; G08B 29/145; G08B 17/00; G08B 29/14; G08B 3/10; G08B 29/181; G08B 25/10; G08B 29/183
USPC ..... 340/500, 540, 603, 627, 628, 633, 634, 340/514, 636.19
See application file for complete search history.

(56) References Cited

U.S. PATENT DOCUMENTS

| | | | |
|---|---|---|---|
| 4,827,244 | A | 5/1989 | Bellavia et al. |
| 4,870,394 | A | 9/1989 | Corl et al. |
| 4,901,056 | A | 2/1990 | Bellavia et al. |
| 4,954,816 | A | 9/1990 | Mattison |
| 5,140,269 | A | 8/1992 | Champlin |
| 5,283,816 | A | 2/1994 | Gomez Diaz |
| 5,594,410 | A | 1/1997 | Lucas et al. |
| 5,905,438 | A | 5/1999 | Weiss et al. |
| 6,140,269 | A | 10/2000 | Hoshi |
| 6,172,612 | B1 | 1/2001 | Odachowski et al. |
| 6,288,637 | B1 | 9/2001 | Thomas et al. |

(Continued)

OTHER PUBLICATIONS

First Alert User's Manual Remote Flashlight Test Smoke Alarm with Silence Feature (SA88B, SA88C) & Remote Flashlight Test Smoke Alarm with Silence Feature and 2-Year Extended Life Battery (SA89B, SA89C), 6 pgs.

(Continued)

*Primary Examiner* — James Yang
(74) *Attorney, Agent, or Firm* — Fish & Richardson P.C.

(57) ABSTRACT

A testing device is provided that may be attachable and detachable from a smoke detector. The testing device may have a rod that pushes a testing button on the smoke detector. The testing device may have a light detector which will actuate the rod to push the testing button if the light from an appropriate remote control or other light source is directed onto it, in order to verify that the smoke detector is operating properly without manually pushing the testing button. The testing device may store a unique identifier (ID) and generate and transmit data pertaining to results of the testing of the smoke detector.

19 Claims, 5 Drawing Sheets

(56) References Cited

U.S. PATENT DOCUMENTS

| | | | | |
|---|---|---|---|---|
| 6,838,988 | B2 * | 1/2005 | Lennartz et al. | 340/539.26 |
| 7,397,359 | B2 | 7/2008 | Sparacino | |
| 2006/0229108 | A1 * | 10/2006 | Cehelnik | 455/569.1 |
| 2007/0080819 | A1 | 4/2007 | Marks et al. | |
| 2008/0084291 | A1 | 4/2008 | Campion et al. | |
| 2008/0291036 | A1 | 11/2008 | Richmond | |
| 2009/0174562 | A1 * | 7/2009 | Jacobus et al. | 340/636.1 |

OTHER PUBLICATIONS

First Alert User's Manual Smoke and Fire Alarm, Remote Flashlight Test Smoke Alarm & Remote Flashlight Test Smoke Alarm with Escape Light Feature (models SA90B, SA150B), 5 pgs.

* cited by examiner

SMOKE DETECTOR TESTING

CROSS-REFERENCE TO RELATED APPLICATIONS

The present application is a continuation patent application of U.S. patent application Ser. No. 12/247,417, filed Oct. 8, 2008, now U.S. Pat. No. 8,466,800, which is a divisional patent application of U.S. patent application Ser. No. 12/139,901 filed Jun. 16, 2008, the entirety of which is hereby incorporated by reference herein. Further, this application is related by subject matter to that disclosed in the following commonly assigned application, the entirety of which is hereby incorporated by reference herein: U.S. patent application Ser. No. 12/247,405, filed Oct. 8, 2008.

BACKGROUND

A smoke detector is a device that detects smoke and issues an alarm to alert nearby people that there is a potential fire. Because smoke rises, most smoke detectors are mounted on the ceiling or on a wall near the ceiling. Virtually all modern smoke detectors come equipped with a test button that activates a test function. The purpose of the test function is to provide a means to test the power supply and/or the associated detection circuitry prior to actual smoke having been detected. Such testing is may be used to verify that the smoke detector is working properly. Such detection circuitry usually includes a manually operable push button switch for the purpose of initiating the detector test function.

Some smoke detectors include an integrated photosensor. A control beam of incident electromagnetic energy can be provided from a remotely located portable source such as a flashlight. Directing the beam of radiant energy from the flashlight against the smoke detector's photosensor causes the smoke detector to initiate a test sequence.

SUMMARY

A testing device is provided that may be attachable and detachable from a smoke detector. The testing device may have a rod that pushes a testing button on the smoke detector. The testing device may have a light detector which will actuate the rod to push the testing button if the light from an appropriate remote control or other light source is directed onto it, in order to verify that the smoke detector is operating properly without manually pushing the testing button. The testing device may store a unique identifier (ID) and generate and transmit data pertaining to results of the testing of the smoke detector.

In an implementation, the testing device may receive infrared (IR) light from a remote control. The IR light may trigger the testing device to test the smoke detector.

In an implementation, the remote control may be an IR enabled device. The remote control may be integrated within a mobile device such as a mobile phone, personal digital assistant (PDA), or a handheld computing device.

In an implementation, the remote control may be integrated within or in communication with a computing device such as a personal computer (PC), a mobile phone, PDA, or handheld computing device. The remote control and/or the computing device may collect, store, analyze, and/or display data pertaining to the testing of the smoke detector with the testing device.

This summary is provided to introduce a selection of concepts in a simplified form that are further described below in the detailed description. This summary is not intended to identify key features or essential features of the claimed subject matter, nor is it intended to be used to limit the scope of the claimed subject matter.

BRIEF DESCRIPTION OF THE DRAWINGS

The foregoing summary, as well as the following detailed description of illustrative embodiments, is better understood when read in conjunction with the appended drawings. For the purpose of illustrating the embodiments, there are shown in the drawings example constructions of the embodiments; however, the embodiments are not limited to the specific methods and instrumentalities disclosed. In the drawings.

DETAILED DESCRIPTION

Figure 1:
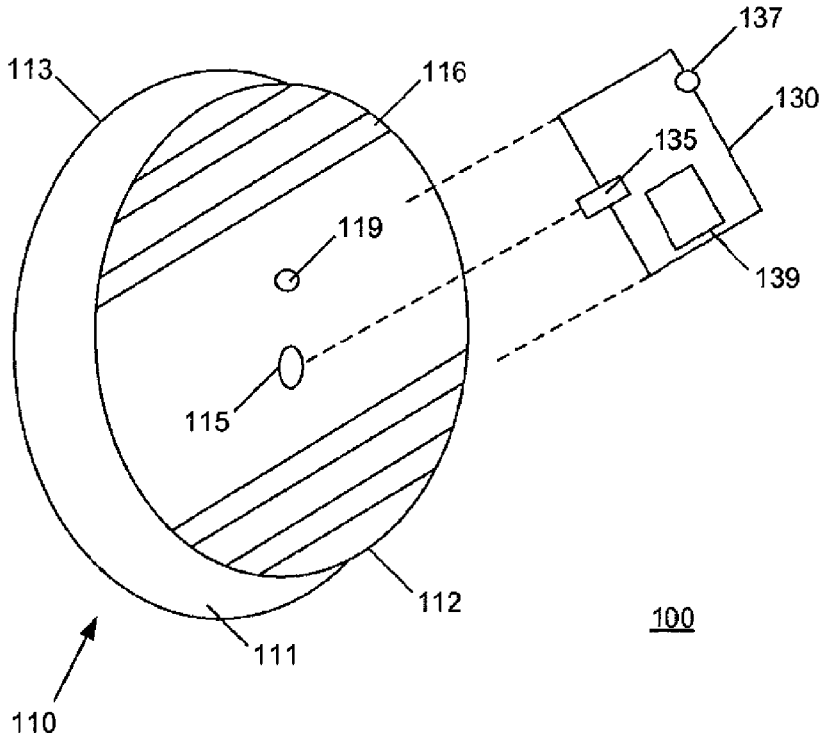
FIG. 1 is a block diagram of an implementation of a system that may be used for smoke detector testing.

FIG. 1 is a block diagram of an implementation of a system 100 that may be used for smoke detector testing. A smoke detector 110 is provided and may be any conventional smoke detector, such as a residential or business smoke detector that is powered by batteries or is wired into the circuitry of the residence or business. Although the illustrative embodiments described herein describe the testing of a smoke detector, any type of detector or alarm device may be tested, such as a fire detector, a heat detector, and a carbon monoxide detector. It is contemplated that any type of detector with a test circuit or testing button may be used with the example embodiments and aspects described herein.

Generally, for example, the smoke detector 110 may have a circular plastic housing 111 with a front side 112 and a rear side 113. The housing 111 has in the region of the front side thereof a plurality of slots 116 which permit the entry of smoke, heat and the like into the housing 111 and permit an audible alarm sound generated by the smoke detector to leave the housing 111. In approximately the middle of the front side of the housing 111 is a push-to-test button 115 (referred to herein as a "testing button"), which can be manually pushed to trigger an alarm, via a test circuit 122 (shown in FIG. 2), in order to verify that the smoke detector 110 is operating properly. Near the testing button 115 may be an operating light emitting diode (LED) 119 which may periodically flash to indicate the smoke detector 110 is operating.

A testing device 130 is separate from the smoke detector 110 and is removable such that the testing device 130 may be attachable and detachable from the smoke detector 110. The testing device 130 may have a rod 135 that pushes the testing button 115. The testing device 130 may have a light detector 137 which will actuate the rod 135 to push the testing button 115 if the light from an appropriate remote control or other light source is directed onto it, in order to verify that the smoke detector 110 is operating properly without manually pushing the testing button 115.

The testing device 130 may store a unique identifier (ID) and generate and transmit data pertaining to results of the testing of the smoke detector. In an implementation, the testing device 130 may comprise a controller, a processor, one or program modules, and/or storage, shown collectively as 139, that may be appropriately configured to perform such functionality. For example, the testing device 130 may detect the alarm that results from the testing button 115 being pushed if the smoke detector 110 is operating properly. The testing device 130 may record whether or not an alarm was detected pursuant to a test along with a date and time, for example. Such data may be provided to a remote control and/or a computing device as described further herein.

The testing device 130 may be adapted to fit on any type of smoke detector, as a flat pack with probes (installed between the connection points of the testing button 115) or as an extending piece, for example, that may be mounted on the smoke detector 110 over the testing button 115 or in proximity of the testing button 115. The testing device 130 may be attached to the casing of the smoke detector 110 by a user using an adhesive or other mechanical means and/or hardware for example. The testing device 130 may be detached or otherwise removed from the smoke detector 110 by the user at any time. In an implementation, the testing device may be powered by the smoke detector 110 or may be powered by batteries.

Figure 2:
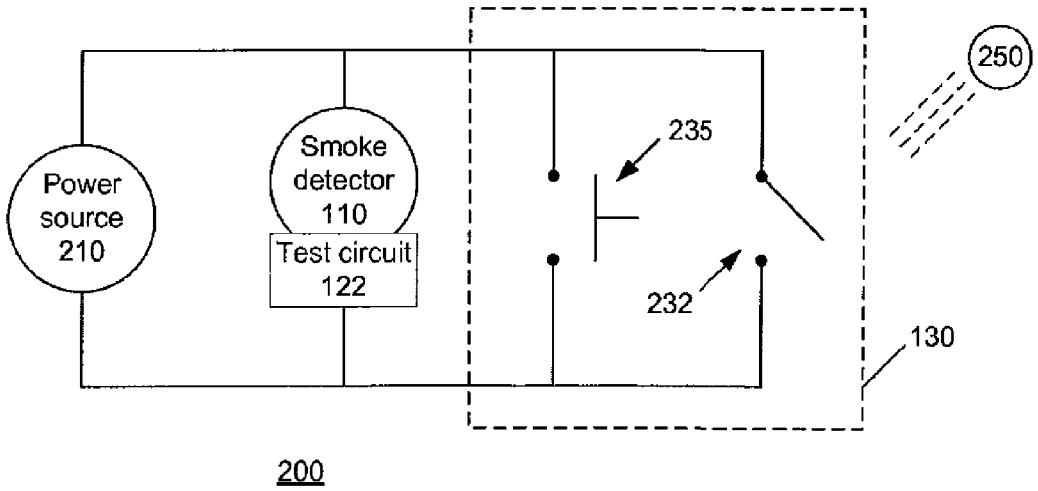
FIG. 2 is a diagram of an implementation of a smoke detector testing system.

FIG. 2 is a diagram of an implementation of a smoke detector testing system 200. The smoke detector 110 is connected to a power source 210, such as an alternating current or direct current voltage source. The testing device 130 may comprise an electronic switch 232 and a physical (e.g., mechanical) switch 235. The electronic switch 232 may comprise the light detector 137 and may comprise a light detecting diode or an infrared (IR) sensitive phototransistor for example. The electronic switch 232 may actuate the physical switch 235 comprising the rod 135 for example, to push the testing button 115 on the smoke detector 110. The electronic switch 232 may be activated by a light source 250, such as an IR light source.

In an alternative implementation, when IR light is present, the electronic switch 232 may act as an electronic trigger that charges a test circuit 122 in the smoke detector 110, bypassing the testing button 115. In such a scenario, the physical switch 235 may not be used.

A remote control may act as the light source 250 and may provide IR light to the testing device 130. A remote control is an electronic device, typically powered by batteries, that is used for the remote operation of a machine. Commonly, remote controls are used to issue commands from a distance to televisions or other consumer electronics such as stereo systems and video players. Remote controls for these devices are usually small wireless handheld objects with an array of buttons for adjusting various settings such as channel, track number, and volume. Remote controls may be single channel (single-function, one-button) or multi-channel (normal multi-function).

Many remote controls communicate to their respective devices via IR signals. A near infrared diode may be used to emit a beam of light that reaches the device. Such a remote control may be used to emit a beam of light towards to the testing device 130. A 940 nm wavelength LED is typical, although any wavelength(s) of IR may be used.

A universal remote is a remote control that can be programmed to operate various brands of one or more types of consumer electronics devices. Some universal remotes allow the user to program in new control codes to the remote control. Many remote controls sold with various electronic devices include universal remote capabilities for other types of devices, which allow the remote control to control other devices beyond the device it came with. IR learning remotes can learn the code for any button on many other IR remote controls. This functionality allows the remote control to learn functions not supported by default for a particular device, making it sometimes possible to control devices that the remote control was not originally designed to control. It is contemplated that any of these types of remote controls may be used in accordance with the examples and embodiments described herein.

Figure 3:
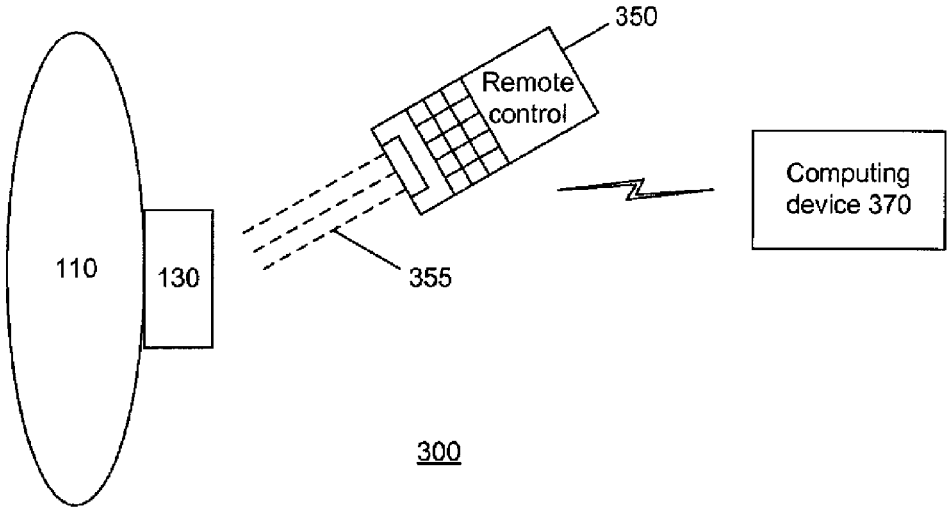
FIG. 3 is a block diagram of another implementation of a system that may be used for smoke detector testing.

FIG. 3 is a block diagram of another implementation of a system 300 that may be used for smoke detector testing. A smoke detector 110 with an attached testing device 130 is shown as receiving IR light 355 from a remote control 350. In an implementation, the presence of any IR light (e.g., for a predetermined amount of time such as at least one second) may trigger the testing device 130 to test the smoke detector 110. Alternatively or additionally, a certain frequency of IR light may trigger the testing device 130 to test the smoke detector 110.

The remote control 350 may be an IR enabled device, such as one of the IR remote controls described above. Alternatively or additionally, the remote control 350 may be integrated within a mobile device such as a mobile phone, personal digital assistant (PDA), or a handheld computing device. It is contemplated that any light source that provides IR light may be used as the remote control 350.

In an implementation, the remote control 350 may be integrated within or in communication with a computing device 370 such as a personal computer (PC), a mobile phone, PDA, or handheld computing device for example. The remote control 350 and/or the computing device 370 may collect data pertaining to the testing of the smoke detector 110 with the testing device 130. In an implementation, the remote control 350 may receive data from the testing device 130, and may provide some or all of the data to the computing device 370. The remote control 350 and/or the computing device 370 may store, analyze, and/or display the collected data. An example computing device is described with respect to FIG. 7.

Figure 4:
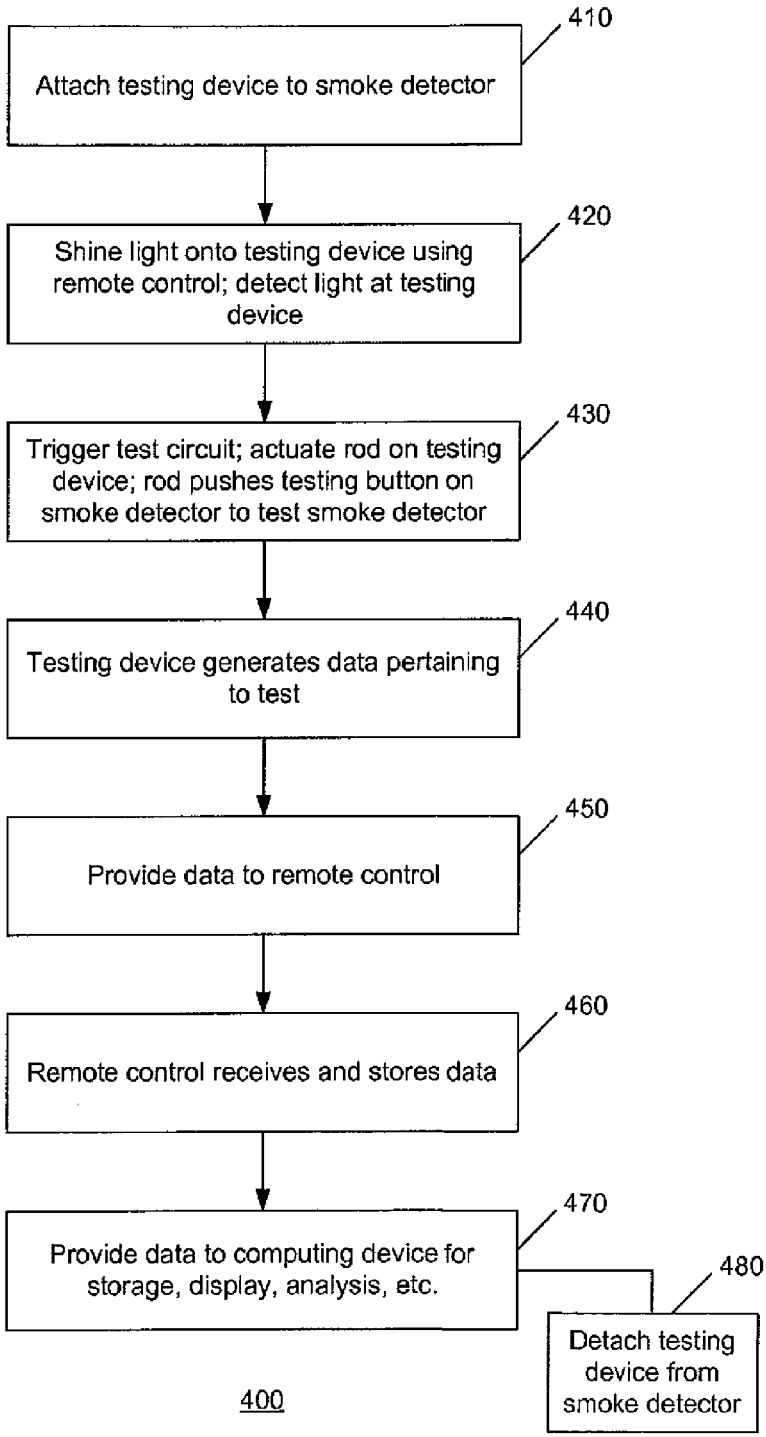
FIG. 4 is an operational flow of an implementation of a method that may be used for smoke detector testing.

FIG. 4 is an operational flow of an implementation of a method 400 that may be used for smoke detector testing. At 410, a testing device that is removable may be attached to a smoke detector. At 420, a user may shine a light, such as IR light, onto the testing device using a remote control or other light source, and the testing device may detect the light. Upon receiving the light, the testing device may cause a test circuit of the smoke detector to be triggered at 430. In an implementation, a rod of the testing device may be actuated at 430, and the rod may push the testing button, thereby testing the smoke detector.

At 440, the testing device may generate data pertaining to the test, such as results, e.g., pass or fail, and date and time of testing, and provide the data to the remote control at 450. The remote control may be in a mode to receive data (e.g., a program mode) and may receive and store the data at 460 in associated internal or external storage and/or may provide the data to a computing device at 470 for subsequent storage, display, analysis, etc. In an implementation, the testing device may provide the data directly to the computing device. At any time, shown at 480, the testing device may be detached from the smoke detector, e.g., by the user.

Figure 5:
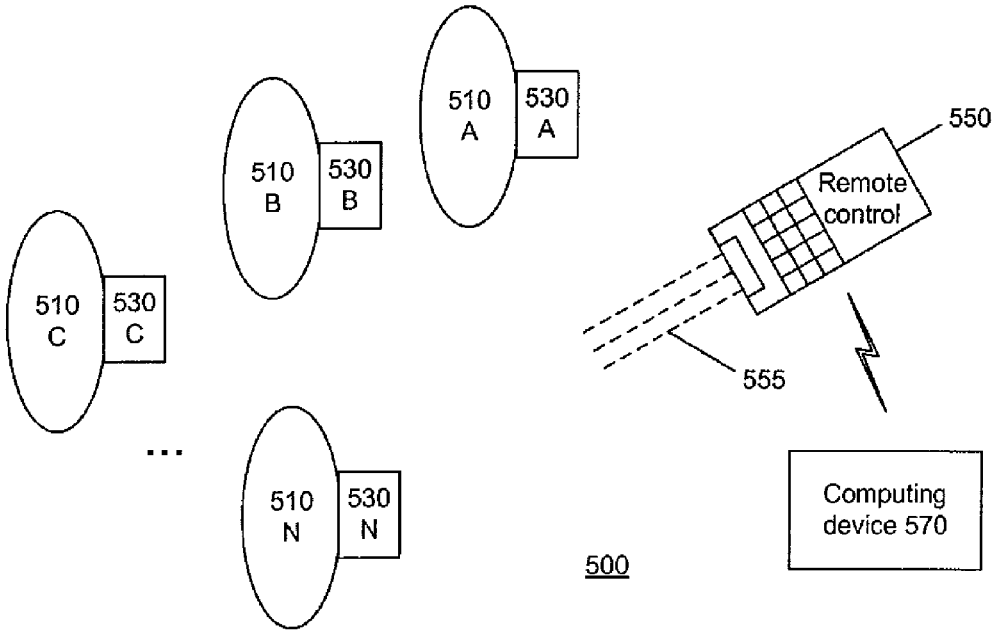
FIG. 5 is a block diagram of another implementation of a system that may be used for smoke detector testing.

FIG. 5 is a block diagram of another implementation of a system 500 that may be used for smoke detector testing. Multiple testing devices 530A through 530N, where N may be any number, may be disposed on associated smoke detectors 510A through 510N, respectively. Each testing device may have a unique ID that may be stored in storage associated with the testing device.

A remote control 550 may activate any one of the testing devices 530A-530N at a particular time by providing IR light 555 to the testing device, thereby testing the smoke detector associated with that testing device. The remote control 550 may be able to activate each of the testing devices 530A-530N. In an implementation, the same IR (e.g., frequency, duration, etc.) may be used to activate each of the testing devices 530A-530N.

A computing device 570, either integrated with the remote control 550 or separate from the remote control 550, may be in communication with the remote control 550, and may receive and store data associated with the tests of the smoke detectors 510A-510N. Each testing device may send its ID to the remote control 550 and/or the computing device 570 along with the data. The ID along with the associated data may be stored by the remote control 550 and/or the computing device 570. After receiving the data from the remote control 550 and/or the testing device(s) 530A-530N, the computing device 570 may use tools, applications, and aggregators, for example, to store, analyze, and/or display the data.

Figure 6:
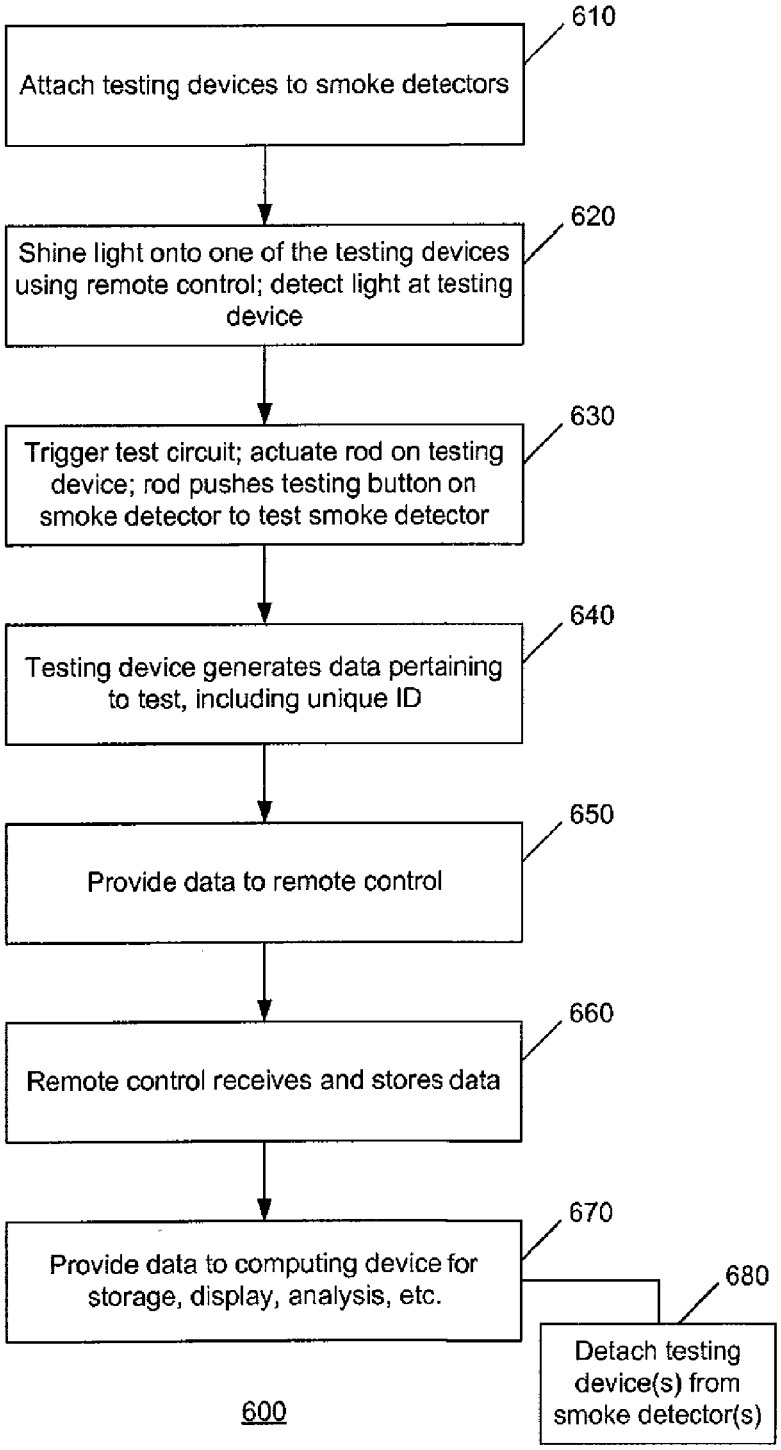
FIG. 6 is an operational flow of another implementation of a method that may be used for smoke detector testing.

FIG. 6 is an operational flow of another implementation of a method 600 that may be used for smoke detector testing. At 610, testing devices may be attached to smoke detectors, one testing device to each smoke detector. Each testing device may be removable and may have a unique ID. At 620, a user may shine a light, such as IR light, onto one of the testing devices using a remote control, to test associated smoke detector. The testing device may detect the light. At 630, the test circuit of the associated smoke detector may be triggered responsive to the testing device detecting the IR light. In an implementation, the testing device's rod may be actuated and may push the smoke detector's testing button, thereby testing the smoke detector.

At 640, responsive to the test, the testing device may generate data such as an ID, results, e.g., pass or fail, and date and time of testing, and provide the data to the remote control at 650. The remote control may store the data at 660 in associated internal or external storage and/or may provide the data to a computing device at 670 for subsequent storage, display, analysis, etc. In an implementation, the data may be provided directly to the computing device from the testing device. At any time, shown at 680, one or more of the testing devices may be detached from their associated smoke detectors.

Exemplary Computing Arrangement

Figure 7:
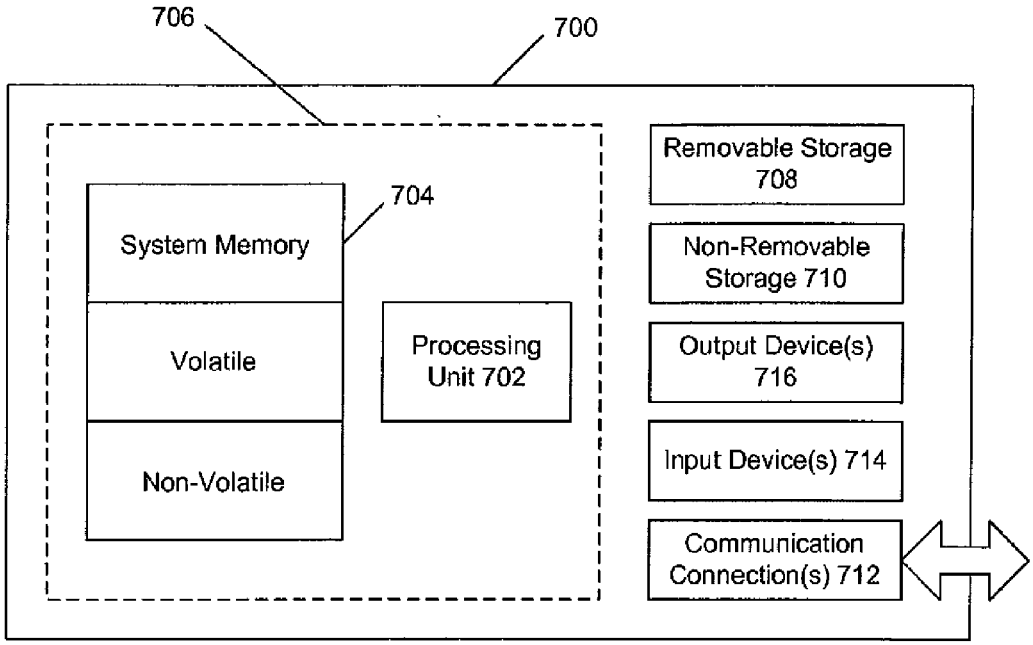
FIG. 7 is a block diagram of an example computing environment in which example embodiments and aspects may be implemented.

FIG. 7 shows an exemplary computing environment in which example embodiments and aspects may be implemented. The computing system environment is only one example of a suitable computing environment and is not intended to suggest any limitation as to the scope of use or functionality.

Numerous other general purpose or special purpose computing system environments or configurations may be used. Examples of well known computing systems, environments, and/or configurations that may be suitable for use include, but are not limited to, PCs, server computers, handheld or laptop devices, multiprocessor systems, microprocessor-based systems, network PCs, minicomputers, mainframe computers, embedded systems, distributed computing environments that include any of the above systems or devices, and the like.

Computer-executable instructions, such as program modules, being executed by a computer may be used. Generally, program modules include routines, programs, objects, components, data structures, etc. that perform particular tasks or implement particular abstract data types. Distributed computing environments may be used where tasks are performed by remote processing devices that are linked through a communications network or other data transmission medium. In a distributed computing environment, program modules and other data may be located in both local and remote computer storage media including memory storage devices.

With reference to FIG. 7, an exemplary system for implementing aspects described herein includes a computing device, such as computing device 700. In its most basic configuration, computing device 700 typically includes at least one processing unit 702 and system memory 704. Depending on the exact configuration and type of computing device, system memory 704 may be volatile (such as random access memory (RAM)), non-volatile (such as read-only memory (ROM), flash memory, etc.), or some combination of the two. This most basic configuration is illustrated in FIG. 7 by dashed line 706.

Computing device 700 may have additional features and/or functionality. For example, computing device 700 may include additional storage (removable and/or non-removable) including, but not limited to, magnetic or optical disks or tape. Such additional storage is illustrated in FIG. 7 by removable storage 708 and non-removable storage 710.

Computing device 700 typically includes a variety of computer-readable media. Computer-readable media can be any available media that can be accessed by computing device 700 and include both volatile and non-volatile media, and removable and non-removable media. By way of example, and not limitation, computer-readable media may comprise computer storage media and communication media.

Computer storage media include volatile and non-volatile, and removable and non-removable media implemented in any method or technology for storage of information such as computer-readable instructions, data structures, program modules or other data. System memory 704, removable storage 708, and non-removable storage 710 are all examples of computer storage media. Computer storage media include, but are not limited to, RAM, ROM, Electrically Erasable Programmable Read-Only Memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 700. Any such computer storage media may be part of computing device 700.

Computing device 700 may also contain communication connection(s) 712 that allow the computing device 700 to communicate with other devices. Communication connection(s) 712 is an example of communication media. Communication media typically embody computer-readable instructions, data structures, program modules, or other data in a modulated data signal such as a carrier wave or other transport mechanism, and include any information delivery media. The term "modulated data signal" means a signal that has one or more of its characteristics set or changed in such a manner as to encode information in the signal. By way of example, and not limitation, communication media include wired media such as a wired network or direct-wired connection, and wireless media such as acoustic, radio frequency (RF), infrared, and other wireless media. The term computer-readable media as used herein includes both storage media and communication media.

Computing device 700 may also have input device(s) 714 such as a keyboard, mouse, pen, voice input device, touch input device, etc. Output device(s) 716 such as a display, speakers, printer, etc. may also be included. All these devices are well known in the art and need not be discussed at length here.

Computing device 700 may be one of a plurality of computing devices 700 inter-connected by a network. As may be appreciated, the network may be any appropriate network, each computing device 700 may be connected thereto by way of communication connection(s) 712 in any appropriate manner, and each computing device 700 may communicate with one or more of the other computing devices 700 in the network in any appropriate manner. For example, the network may be a wired or wireless network within an organization or home or the like, and may include a direct or indirect coupling to an external network such as the Internet or the like.

It should be understood that the various techniques described herein may be implemented in connection with hardware or software or, where appropriate, with a combination of both. Thus, the methods and apparatus of the presently disclosed subject matter, or certain aspects or portions thereof, may take the form of program code (i.e., instructions) embodied in tangible media, such as floppy diskettes, CD-ROMs, hard drives, or any other machine-readable storage medium wherein, when the program code is loaded into and executed by a machine, such as a computer, the machine becomes an apparatus for practicing the presently disclosed subject matter. In the case of program code execution on programmable computers, the computing device generally includes a processor, a storage medium readable by the processor (including volatile and non-volatile memory and/or storage elements), at least one input device, and at least one output device.

One or more programs may implement or utilize the processes described in connection with the presently disclosed subject matter, e.g., through the use of an application programming interface (API), reusable controls, or the like. Such programs may be implemented in a high level procedural or object-oriented programming language to communicate with a computer system. However, the program(s) can be implemented in assembly or machine language, if desired. In any case, the language may be a compiled or interpreted language and it may be combined with hardware implementations.

Although exemplary embodiments may refer to utilizing aspects of the presently disclosed subject matter in the context of one or more stand-alone computer systems, the subject matter is not so limited, but rather may be implemented in connection with any computing environment, such as a network or distributed computing environment. Still further, aspects of the presently disclosed subject matter may be implemented in or across a plurality of processing chips or devices, and storage may similarly be effected across a plurality of devices. Such devices might include PCs, network servers, and handheld devices, for example.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. A testing system, comprising:

a remote device; and a testing device attachable to a detecting device and configured to be powered by the detecting device, the testing device comprising:

a member configured to be aligned with a test button on the detecting device when the testing device is attached to the detecting device; and a detector operatively connected to the member and configured to detect a light signal transmitted by the remote device, and cause, in response to detecting the light signal, the member to push the test button on the detecting device.

2. The testing system of claim 1, wherein the light signal detected from the remote device comprises an infrared light generated by the remote device.

3. The testing system of claim 1, wherein the remote device comprises a mobile device.

4. The testing system of claim 1, wherein the remote device is configured to store testing data generated by the testing device.

5. The testing system of claim 1, wherein the member comprises a rod.

6. The testing system of claim 1, wherein the remote device is in communication with a computing device and is configured to provide data generated by the testing device to the computing device.

7. A testing device operable by a remote device and configured to be attachable to and powered by a detecting device, the testing device comprising:

a member configured to be aligned with a test button on the detecting device when the testing device is attached to the detecting device;

a detector operatively connected to the member and configured to detect a light signal transmitted by the remote device, and cause, in response to detecting the light signal, the member to push the test button on the detecting device; and a storage component operatively connected to the detector and configured to store testing data generated at the testing device.

8. The testing device of claim 7, wherein storage component is further configured to store an identifier unique to the testing device.

9. The testing device of claim 7, wherein the detected signal comprises a particular frequency of infrared light generated by the remote device.

10. The testing device of claim 7, wherein the remote device comprises a computing device.

11. The testing device of claim 7, wherein the testing device comprises a flat pack with probes attachable to the detecting device between connection points of the testing button.

12. The testing device of claim 7, wherein the testing device comprises an extending piece attachable to the detecting device in proximity to the testing button.

13. The testing device of claim 7, wherein the testing device is in communication with a computing device and is configured to provide data generated by the testing device to the computing device.

14. The testing device of claim 7, wherein the storage component configured to store testing data is configured to store testing data comprising at least one of a pass result, a fail result, a time of the test, and a date of the test.

15. A testing method, comprising:

attaching a first detachable testing device to a first detecting device;

attaching a second detachable testing device to a second detecting device;

testing the first detecting device by causing a first rod on the first testing device to push a testing button on the first detecting device in response to receiving a first light signal from a remote device; and testing the second detecting device by causing a second rod on the second testing device to push a testing button on the second detecting device in response to receiving a second light signal from the remote device, wherein the first testing device is configure to be powered by the first detecting device and the second testing device is configure to be powered by the second detecting device.

16. The method of claim 15, further comprising adapting the first and the second detachable testing devices to fit the first and the second detecting devices, respectfully.

17. The method of claim 15, further comprising:

storing, in a storage component of the first detachable testing device, a result of the testing of the first detachable testing device; and storing, in a storage component of the second detachable testing device, a result of the testing of the second detachable testing device.

18. The method of claim 15, further comprising receiving at a computing device testing data generated by the first detachable testing device and the second detachable testing device, wherein the computing device comprises non-transitory computer readable instructions executable by a processing resource to perform at least one of analyzing the received data, displaying the received data, and storing the received data.

19. The method of claim 15, wherein the first and the second detecting devices comprise at least one of a smoke detector, a heat detector, a fire detector, and a carbon monoxide detector.

* * * * *